United States Patent [19]

Mackal

[11] Patent Number: 5,062,546

[45] Date of Patent: Nov. 5, 1991

[54] SNAP RIVET SAFETY LOCK FOR INFLATORS

[76] Inventor: Glenn H. Mackal, 4923 59th Ave. S., St. Petersburg, Fla. 33715

[21] Appl. No.: 523,106

[22] Filed: May 15, 1990

[51] Int. Cl.[5] ..... B67D 5/00

[52] U.S. Cl. ..... 222/3; 222/541; 441/92

[58] Field of Search ..... 441/92, 93, 94; 116/306; 24/703.2; 403/2; 411/119, 508, 509, 510, 913; 222/3, 5, 153, 505, 541

[56] References Cited

U.S. PATENT DOCUMENTS

| | | | |
|---|---|---|---|
| 3,185,413 | 5/1965 | Walker | 403/2 |
| 3,437,245 | 4/1969 | Herpert et al. | 222/541 |
| 3,602,065 | 8/1971 | Ratcliff | 403/2 |
| 3,809,288 | 4/1974 | Mackal | 222/5 |
| 4,260,075 | 4/1981 | Mackal | 222/5 |
| 4,309,911 | 1/1982 | McCall | 73/862.53 |
| 4,587,987 | 5/1986 | West | 137/70 |
| 4,893,978 | 1/1990 | Frano | 411/508 |

FOREIGN PATENT DOCUMENTS

| | | | |
|---|---|---|---|
| 0997710 | 7/1965 | United Kingdom | 411/508 |

*Primary Examiner*—Michael S. Huppert
*Assistant Examiner*—Kenneth Bomberg
*Attorney, Agent, or Firm*—Joseph C. Mason, Jr.; Ronald E. Smith

[57] ABSTRACT

A safety lock for preventing inadvertent activation of an inflator of the type connected to a gas cartridge for the rapid inflation of inflatable articles. A common bore extends through the inflator body and a bell crank that causes piercing of the gas cartridge when rotated about a pivot shaft. A rivet extends through the bore and keys the crank to the inflator body so that the crank cannot be inadvertently pivoted. The rivet includes a weak middle section that breaks when a firm force is exerted upon the bell crank, thereby assuring that the safety lock does not prevent intentional activation of the inflator. The second end of the rivet includes a pair of resilient prongs that negate the need for a second head on the rivet.

2 Claims, 2 Drawing Sheets

SNAP RIVET SAFETY LOCK FOR INFLATORS

TECHNICAL FIELD

This invention relates, generally, to safety locks for inflators of the type employed for the rapid inflation of life vests, life rafts and other inflatable articles.

BACKGROUND ART

Inflators are devices that screw threadedly engage gas cartridges such as $CO_2$ cartridges, and which contain a mechanism for puncturing the gas cartridge when it is desired to achieve rapid inflation of an inflatable article. The mechanism includes a pivotally mounted bell crank that is rotatably mounted about a pivot shaft carried by the inflator. Pulling a lanyard effects pivoting of the bell crank and a part of the crank cammingly engages a cartridge-piercing pin and drives it into the cartridge to thereby release the gases therefrom.

One problem with this type of inflator is that the force required to rotate the bell crank about its pivot shaft is not great; even a slight tug on the lanyard may result in the piercing of the cartridge. For example, a small tug by an airline flight attendant performing a demonstration may activate an unprotected inflator.

Accordingly, the art has developed a frangible plastic rivet that extends through the inflator housing and the bell crank to tie those items together and to thereby guard against inadvertent piercing of a cartridge. Just as in metal rivets, the plastic rivets initially have a single head and shaft; the shaft is inserted into a bore formed in the inflator and bell crank and a second head is then formed on the protruding end of the shaft. Obviously, the forming of the second head is time-consuming and expensive.

Thus, there remains a need for an inflator safety lock of improved design, but the prior art, taken as a whole, neither teaches nor suggests how to improve the rivet construction now in use.

DISCLOSURE OF INVENTION

The bell crank of an inflator is held in place to defeat inadvertent rotation thereof by a novel frangible rivet member of plastic construction. Two embodiments of the novel rivet are shown.

In both embodiments, the rivet has a pair of transversely spaced apart, barbed insertion prongs at its leading end; the prongs are inserted into a bore formed in the inflator and the bell crank and are transiently driven toward one another when so inserted. Upon full insertion, the prongs, which are resilient, resume their original position of repose; the barbs formed therein prevent inadvertent retraction of the prongs from the bore.

In a first embodiment, an elongate, breakable narrow rod member is formed integrally with the prongs and projects therefrom in trailing relation thereto; the rod is also positioned in the bore when the rivet is fully inserted therein.

In a second embodiment, the rod member is changed into a flat plate member so that the rivet is more easily inserted into position. The flat plate is breakable from the balance of the rivet at its opposite ends.

In both embodiments, a rivet handle trails the rod or flat plate and is perpendicular thereto; when the rivet is fully seated in the bore, the handle lies flush with the external surface of the inflator.

When the lanyard is pulled lightly, the rivet blocks pivoting of the bell crank about its pivot shaft. However, the rod or flat plate part of the rivet breaks if the lanyard is pulled firmly, i.e., intentionally.

Thus it is seen that a general object of this invention is to advance the art of inflators by providing an inflator safety lock.

A more specific object is to provide a safety lock of simple yet effective construction.

These and other objects and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
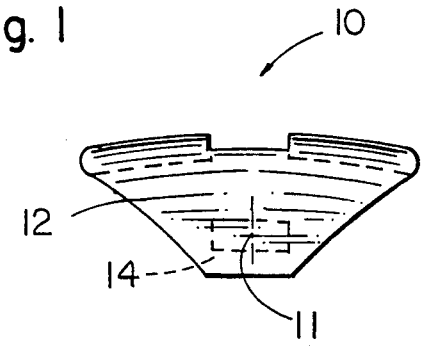
FIG. 1 is a top plan view of a first embodiment of the novel rivet.

The first embodiment of the novel rivet 10, as shown in FIG. 1, has a generally sector-shaped handle 12. The main body of rivet 10 is denoted 14, generally, and depends from handle 12 as perhaps best understood in connection with FIGS. 2 and 3; body 14 has a longitudinal axis of symmetry 11 that is orthogonal to the plane of handle 12.

Figure 3:
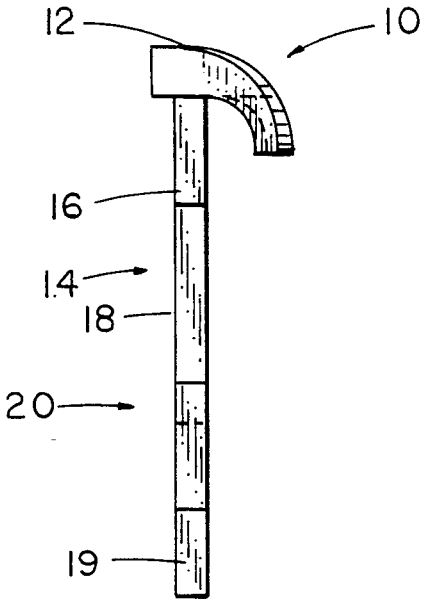
FIG. 3 is a side elevational view thereof.

Body 14 is generally flat as best shown in FIG. 3 and includes base 16, frangible narrow rod 18, and a pair of transversely spaced apart prongs 20 having anti-retraction barbs 19 formed therein.

Importantly, base 16 has a greater transverse extent than rod 18; it should therefore be understood that rod 18 is more readily frangible than base 16 due to the limited transverse extent of said rod.

Figure 2:
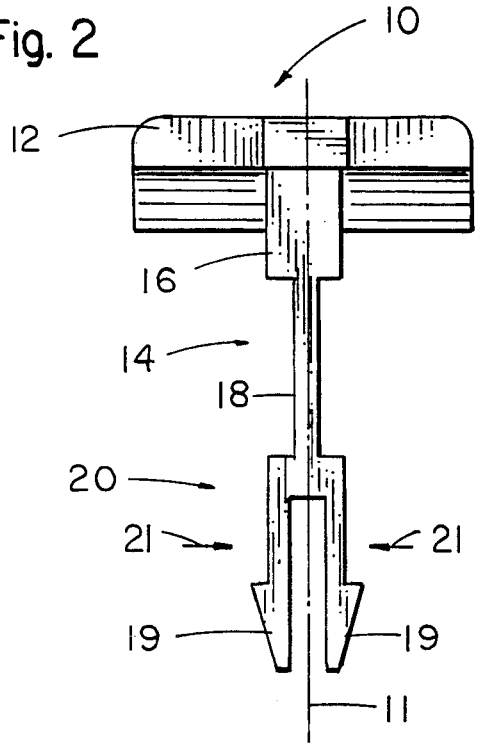
FIG. 2 is a front elevational view thereof.

Prongs 20 are resilient and their position of repose is shown in FIG. 2.

Handle 12 may be thought of as the first head means of the rivet 10, and prongs 20 may be thought of as pre-formed second head means, although said prongs negate the need for a second head.

Figure 4:
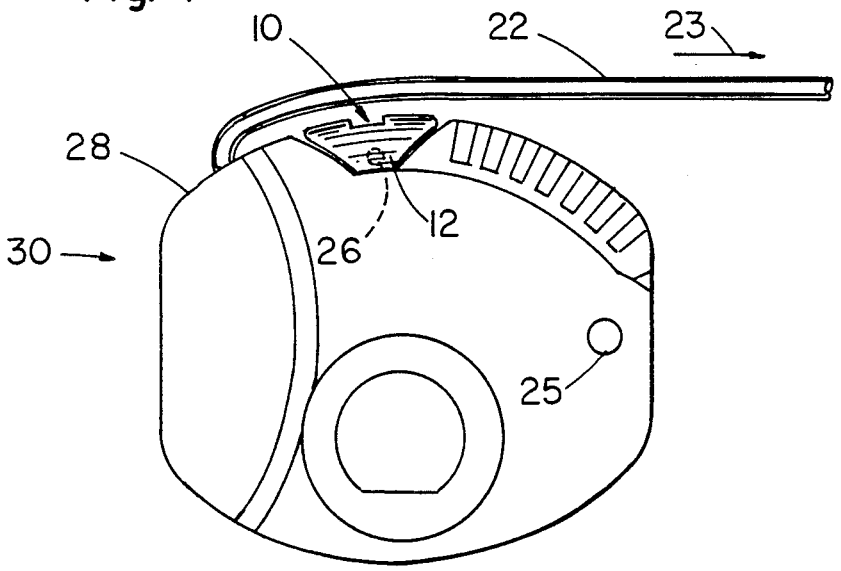
FIG. 4 is a plan view of an inflator showing either embodiment of the novel rivet engaged therewith.

FIG. 4 shows an inflator 30 of the type with which both embodiments of rivet 10 have utility. As is well known, pulling lanyard 22 in the direction of arrow 23 rotates bell crank 24 about pivot shaft 25 and that rotation results in piercing of a gas cartridge, not shown, by a pin, not shown, positioned interiorly of inflator 30.

Importantly, a bore 26 is formed in the body 28 of inflator 30, and extends completely therethrough. Bore 26 also extends through bell crank 24. Rivet main body 14 is slidably received within bore 26 when rivet 10 is in its operative configuration, as should be clear from FIG. 4.

More particularly, prongs 20 form the leading end of rivet 10; they are inserted first into bore 26. The rigidity of the cylindrical side walls of the bore drives the prongs 20 inwardly, i.e., in the direction of confronting arrows 21, 21 in FIG. 2. The diameter of the bore is substantially equal to the transverse extent of base 16, which extent is best shown in FIG. 2. Thus, the prongs are forced inwardly until the respective points of barbs 19, 19 slide within the bore. Upon clearing the bore, the resiliency of barbs 19 returns them to their FIG. 2 position, thereby insuring that rivet 10 cannot be retracted, i.e., the barbs engage diametrically opposite edges of the inflator 30 at the end of the bore. As such, the barbs serve the function of the second head means of rivet 10.

Thus, rivet 10 can be removed from bore 26 by pinching together the protruding leading tip of prongs 19.

As mentioned earlier, bore 26 also passes through bell crank 24. A pull of lanyard 22 in direction 23 will thus be resisted by main body 14 of rivet 10, i.e., bell crank 24 cannot pivot about pivot shaft 25 because rivet 10 keys together the main body 28 of inflator 30 and the bell crank, thereby preventing rotation of the latter. However, a strong, intentional pull on lanyard 22 in direction 23 will break the rivet at rod 18 and the bell crank will be free to rotate and to drive the piercing pin into the gas cartridge.

It should be observed that rivet 10 is reversible, i.e., it can be placed into either end of bore 26. Thus, inflator 30 can be placed on the left or right side of a life vest and rivet 10 has equal utility in either configuration.

Figure 5:
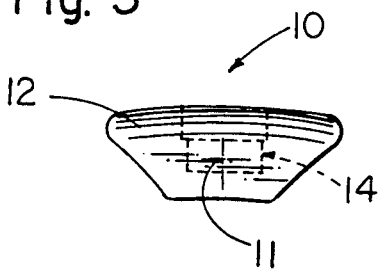
FIG. 5 is a top plan view of the second embodiment.
Figure 6:
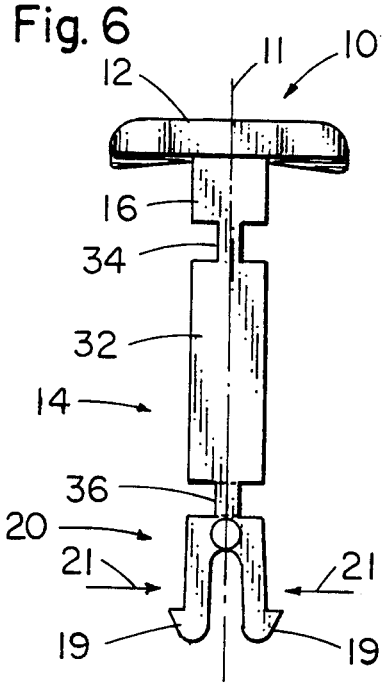
FIG. 6 is a side elevational view thereof.
Figure 7:
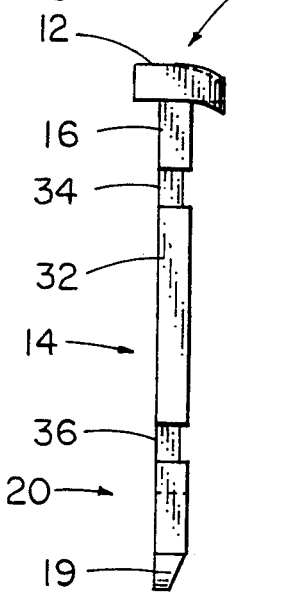
FIG. 7 is a front elevational view thereof.

The second embodiment of rivet 10 is shown in FIGS. 5–7. The structure and manner of operation of this embodiment is essentially the same as that of the first embodiment, as denoted by the common reference numerals. Rod 18 is obviated, however, and flat plate 32 is substituted therefore. The width of plate 32 facilitates insertion of rivet 10 into bore 26, i.e., plate 32 serves as a guide means. Plate 32 has the further advantage of being breakable at two points, i.e., at its opposite ends where it is connected by easily breakable connector members 34, 36 to base 16 and prongs 20, respectively.

Clearly, this invention is new and useful. More importantly, it was not obvious to those of ordinary skill in the art at the time it was made, in view of the prior art considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. A safety lock for inflators of the type having a pivotally mounted bell crank activated by a lanyard, and of the type having a transversely extending bore formed in said inflator and said bell crank when said bell crank is in an unpivoted position; comprising:

a frangible rivet member of generally linear configuration being disposed within said bore;

said rivet member having a first head means and a pre-formed second head means;

a generally flat handle positioned in a first plane;

a linear in configuration main body that depends from said handle in orthogonal relation thereto;

said main body being disposed in said bore when said bell crank is in an unpivoted position relative to said inflator;

said handle being said first head means of said rivet member;

said main body including a bifurcated leading end, a medial part, and a trailing part;

said trailing part abutting said handle and being integrally formed therewith;

said leading end forming said pre-formed second head means;

said leading end including a pair of transversely spaced apart resilient prongs that transiently converge toward one another when inserted into said bore;

a laterally extending anti-retraction barb being formed on each of said prongs adjacent a leading edge thereof, said barbs engaging a rim of said bore when said main body is fully inserted into said bore, said barbs preventing inadvertent retraction of the rivet from the bore;

said trailing part of said main body having a transverse extent substantially equal to the diameter of said bore;

said medial part of said main body having a transverse extent substantially less than the transverse extent of said trailing part, said medial part being breakable when said lanyard is pulled firmly;

said prongs of said leading end of said main body having a collective breadth substantially equal to the transverse extent of said trailing part of said main body;

said leading end, medial part, and trailing part of said main body having a common thickness; and said medial part having a longitudinal extent substantially equal to a longitudinal extent of said leading end and substantially equal to a combined longitudinal extent of said handle and said trailing part;

whereby said bell crank is keyed to said inflator by said frangible rivet member and held against pivoting relative thereto.

2. A safety lock for inflators of the type having a pivotally mounted bell crank activated by a lanyard, and of the type having a transversely extending bore formed in said inflator and said bell crank when said bell crank is in an unpivoted position; comprising:

a frangible rivet member of generally linear configuration being disposed within said bore;

said rivet member having a first head means and a pre-formed second head means;

a generally flat handle positioned in a first plane;

a linear in configuration main body that depends from said handle in orthogonal relation thereto;

said main body being disposed in said bore when said bell crank is in an unpivoted position relative to said inflator;

said main body including a bifurcated leading end, a medial part, and a trailing part;

said trailing part abutting said handle and being integrally formed therewith;

said leading end forming said pre-formed second head means;

said leading end including a pair of transversely spaced apart resilient prongs that transiently converge toward one another when inserted into said bore;

a laterally extending anti-retraction barb being formed on each of said prongs adjacent a leading edge thereto, said barbs engaging a rim of said bore when said main body is fully inserted into said bore, said barbs preventing inadvertent retraction of the rivet from the bore;

said trailing part of said main body having a transverse extent substantially equal to the diameter of said bore;

said medial part of said main body having a transverse extent substantially equal to the transverse extent of said trailing part, said medial part being breakable when said lanyard is pulled firmly;

said prongs of said leading end of said main body having a collective breadth substantially equal to the transverse extent of said trailing part of said main body;

said leading end, medial part, and trailing part of said main body having a common thickness;

said medial part being a flat plate;

said flat plate being connected at its opposite ends to said leading end and said trailing part by narrow, easily breakable connector members;

said connector members being of truncate extent relative to the longitudinal extent of said medial part;

whereby said bell crank is keyed to said inflator by said frangible rivet member and held against pivoting relative thereto.

* * * * *